United States Patent [19]

Kyle et al.

[11] Patent Number: 4,752,405

[45] Date of Patent: Jun. 21, 1988

[54] METAL WORKING LUBRICANT

[75] Inventors: Gerald H. Kyle, Woodridge, Ill.; Patrick W. C. Morrison, Euclid, Ohio

[73] Assignee: Coral Chemical Company, Waukegan, Ill.

[21] Appl. No.: 858,379

[22] Filed: May 1, 1986

[51] Int. Cl.[4] ..... C10M 173/00; C10M 124/40

[52] U.S. Cl. ..... 252/41; 252/49.3; 252/49.5; 252/52 A; 252/56 R

[58] Field of Search ..... 252/41, 49.3

[56] References Cited

U.S. PATENT DOCUMENTS

| | | | |
|---|---|---|---|
| 2,578,585 | 12/1951 | Orozco et al. | 252/28 |
| 2,578,586 | 12/1951 | Orozco et al. | 252/18 |
| 2,613,626 | 10/1952 | Whitney, Jr. | 113/51 |
| 2,753,305 | 7/1956 | Whitbeck | 252/18 |
| 3,313,728 | 4/1967 | Glasson | 252/41 |
| 4,191,801 | 3/1980 | Jahnke | 428/467 |
| 4,262,057 | 4/1981 | Godek et al. | 428/470 |
| 4,350,034 | 9/1982 | Godek et al. | 252/32 X |
| 4,366,077 | 12/1982 | Andrew et al. | 252/49.3 |
| 4,371,476 | 2/1983 | Newkirk et al. | 252/9 X |
| 4,378,299 | 3/1983 | Alexander | 252/49.3 |
| 4,390,438 | 6/1983 | Kennedy et al. | 252/56 D |
| 4,461,712 | 7/1984 | Jonnes | 252/49.3 |
| 4,474,669 | 10/1984 | Lewis | 252/23 |
| 4,518,512 | 5/1985 | Kanamori | 252/49.5 |
| 4,522,733 | 6/1985 | Jonnes | 252/49.3 |
| 4,556,498 | 12/1985 | Carbo et al. | 252/515 R |

*Primary Examiner*—William R. Dixon, Jr.
*Assistant Examiner*—Ellen M. McAvoy
*Attorney, Agent, or Firm*—Fitch, Even, Tabin & Flannery

[57] ABSTRACT

A solid lubricating and coating composition for metal working which composition is suitable for the addition to water for the formation of an aqueous lubricating and coating composition which aqueous composition when dried will form a hard lubricating film on a substrate, such that film will provide lubricity but residues of film will not buildup on metal working tools and dies. The solid composition includes a solid alkali metal salt of a saturated monocarboxylic acid having from about 12 to 30 carbon atoms; polyethylene glycol or a polyoxyethylene glycol having a molecular weight in the range of from about 1500 to about 8000; an acrylic polymer and an effective amount of a surface active agents to effect low hygroscopicity and complete mixing of the ingredients in water.

29 Claims, No Drawings

METAL WORKING LUBRICANT

This invention relates to metal working and metal lubricants therefor. More particularly, this invention relates to a metal working composition and methods of lubricating metal with such composition which composition forms a hard solid film over the substrate metal.

Lubricants generally are employed in metal working and forming operations such as drawing, stamping, punching, cutting, bending and the like. Lubricants facilitate these operations by preventing sticking, decreasing die wear and otherwise extend tool life.

Heretofore lubricants applied for the above purposes ordinarily have provided soft or gel like films, such as those described in U.S. Pat. No. 4,461,712 to Jonnes. As a result, undesirable residues of these lubricants buildup on tools, dies and stamping equipment. These buildups can cause flaws in the finished workpiece. For example, a buildup of lubricant in a stamp operation can result in causing alterations or cracks in surface of the metal being stamped or worked, a phenomenon commonly known as a "blowout". Moreover, soft lubricants provide the metal substrates with little or no actual protection against any impinging and/or abrading surface for which protection is important during storage and transport.

To obtain film strength and hardness in lubricants, as described in U.S. Pat. Nos. 2,578,585 and 2,578,586 to Orozco et al., lubricants often have contained borates. Borates and borax, however, make resulting lubricant films hygroscopic and give such compositions the proclivity to form dust at low temperatures. Formation of dust permits such compositions to "dust off" the metal substrate. Hygroscopicity is undesirable in respect to ferrous metals because with hygroscopic characteristics, the lubricant will take up and retain moisture which will promote rust and corrosion.

As described in U.S. Pat. No. 4,191,801 to Jahnke, certain lubricants are solids at room temperature. These lubricants are melted and then applied to the metal by dipping, spraying or the like. Such lubricants have the disadvantage of having to be melted prior to application, which not only may not be convenient, but potentially consume energy.

An object of the present invention is to provide an improved metal working lubricant and method for protecting and lubricating a metal substrate.

Another object of the present invention is to provide a metal working lubricant with improved lubricity characteristics, low hygroscopicity and which provides a hard dry film which protects the metal substrate and minimizes the residual lubricant buildup on tooling and coiling.

It is still another object of the present invention to provide a composition which will readily dissolve in water for application to a metal substrate.

These and other objects of the invention will become more apparent with reference to the following detailed description.

According to the invention, a solid lubricating and coating composition is provided for metal working which composition is suitable for addition to water to form an aqueous lubricating and coating composition for application to a metal workpiece which upon drying will provide a borate free, hard lubricating coating or film. For the purpose of this application, "workpiece" means any metal object which is a piece of work in the process of manufacture including but not limited to stamping, drawing, punching, cutting and bending. The solid composition comprises from about 55 to about 80 percent by weight of a solid alkali metal salt of a saturated fatty monocarboxylic acid having from about 12 to 30 carbon atoms which may be a chain or branched and which salt has a melting point in the range of from about 105° to about 150° F.; from about 4.5 to about 18 percent by weight of a solid polyethylene glycol or polyoxyethylene alcohol having a molecular weight in the range of about 1,500 to about 8,000, having a melting point in the range of about 120° F. to 160° F., and preferably having a molecular weight between about 3,000 to about 5,000 and preferably with a melting point in the range of about 129° to about 145° F.; from about 0.3 to about 1.2 percent by weight of a solid acrylic polymer having a molecular weight in the range of about 150 to about 1700 and an effective amount of a surface active agent to effect the mixing of all the ingredients of the composition including the salt, polyethylene polymer and acrylic polymer when they are added to water. From about 2.5 to about 8.0 percent by weight of surface active agent having a hydrophilic-lipophilic balance (HLB) in the range of 10 to 11 generally will be used in the invention, the HLB based upon a 0.1 to 20 scale. This surface active agent may be any alkali metal salt taurate of a $C_{12}$ to $C_{22}$ unsaturated fatty acid with an HLB of about 10 to about 11. The composition also contains from about 2.5 to about 7.5 percent by weight of a low HLB surface active agent having an HLB in the range of about 2 to about 3, which is an effective amount to assist in effecting hardening of the aqueous coating upon drying and reducing hygroscopicity of the coating once the film is dried on the workpiece. Preferably the low HLB surface active agent is diethylene glycol stearate or other glycol esters having an HLB in the range of about 2 to about 3, which improves hardness and decreases the hygroscopic properties of the composition such that the composition will not pick up or retain minimum amounts of water. The composition may also contain from about 3 to about 10 percent by weight of a rust preventative such as sodium nitrite.

Preferably, the alkali metal salt of the fatty acid is a sodium or potassium salt, preferably it has from 18 to 20 carbon atoms or a mixture of acid salts having 18 to 20 carbon atoms and a melting point in the range of about 130° to about 140° F. Moreover, with the $C_{12}$ to $C_{30}$ fatty acid salts, minor amounts of alkali metal salts of unsaturated and saturated fatty acids derived from tall oil, castor oil, coconut oil and soybean oil may be present in an amount of about 4 to about 8 percent by weight of the soap. Preferably the dispersing surface active agent is sodium-n-methyl-n-oleoyl taurate which is an anionic surface active agent and is sold by GAF Corporation, New York, N.Y. under the mark of Igepon T-77. Preferably the polyethylene glycol has a molecular weight in the range of 3000 to 4800 which polyethylene glycol is sold by Union Carbide under the mark of Carbowax 3350, which has a molecular weight in the range of 3000 to 3700 and which has a melting point in the range of 54° to 58° C. or under the mark Carbowax 4600 which has a molecular weight in the range of about 4400 to 4800, which has a melting point of 57° to 61° C. Methoxy polyethylene glycol sold by Union Carbide under the names of Carbowax 2000 and Carbowax 5000 also may be used. These methoxy polymers have molecular weight ranges of 1850 to 2150, and 4500 to 5500, respectively, and melting point ranges of 49° to 54° C. and 57° to 63° C. respectively.

The composition of the invention is made by mixing all of the solid components with the solid alkali metal salt, which components include the polyethylene glycol or polyoxyethylene alcohol, the dispersing surface active agent and the low hydrophilic-lipophilic balance surface active agent. The acrylic polymer, which is liquid then is added with mixing yielding a solid powdered lubricant coating composition of the invention.

The composition is applied by dissolving it into water at a temperature in the range of about 120° F. to about 200° F. forming an aqueous solution having a pH of about 8 or above and a concentration of lubricant of 8 to 64 ounces per gallon of water which aqueous solution comprises from about 6 to about 50 percent by weight of the dry lubricant composition of the invention and from about 94 to about 50 percent by weight water. The aqueous composition is applied by dipping, spraying or roll coating, preferably at temperatures in the range of from about 120° F. to 200° F. The concentration of the lubricant generally controls the weight of the coating, a lubricant concentration of 8 ounces per gallon of water providing a coating weight of about 100 mg/ft$^2$ and a lubricant concentration of 42 ounces per gallon of water providing a coating weight of about 1,000 mg/ft$^2$.

After coating the metal substrate may be air dried, or preferably oven dried, at temperatures in the range from about 180° F. to about 210° F. to drive off substantially all water in the lubricant.

An important aspect of the invention is that upon drying, the composition of the invention provides lubricity but also forms a dry film or coating having a hardness in the range of from about 15 to about 7 as measured by ASTM test D-1321 so as to preclude a metal to metal contact during a metal working operation. At coating weights of 100 mg/ft$^2$ to 1,000 mg/ft$^2$ the coating will not crack or break upon the bending or working of the substrate. Metal of tooling contacting metal of a workpiece frequently will cause cracking, flaws or other failures in the workpiece. The lubricity and hardness provided by the coatings of the invention permits metal workpieces to be stamped, drawn or otherwise worked without blow outs and without leaving undesirable excess lubricant on tooling. Moreover, the composition of the invention forms a protective coating which is not only not hygroscopic, but which will adhere to and protect the metal substrate under humid conditions. Further, under relatively dry conditions, coatings provided by the invention are stable and will not lose weight to the atmosphere over extended periods.

EXAMPLE 1

The following dry ingredients were added with mixing into 67 pounds of a soap which is a mixture of about 70 percent by weight sodium stearate and about 30 percent by weight of sodium salts of fatty acids derived from tall oil, castor oil, coconut oil and soybean oil 14 pounds Carbowax 3350 [poly(oxy-1,2 ethanediyl)hydro-w-hydroxy];

8 pounds Igepon T-77 [sodium-n-methyl-n-oleoyl taurate];

3 pounds Pegosperse 100S which has an HLB of 3.8 and is available from Glycol, Inc., Greenwich, Ct. [diethyl glycol stearate]; and 4 pounds sodium nitrite.

After mixing the above, 4 pounds of Acrysol I-94 which is 30% by weight aqueous solution of an acrylic polymer having a 32° F. melting point were added with mixing to the above mixture, with processing continued to complete mixing of the ingredients.

Example 1 of the invention was tested and compared to other commercial lubricants for metal working:

| A | % By Weight |
|---|---|
| Borax only Sodium Borate | about 44.0 |
| High Titre Soap 42° C. | about 35.0 |
| Sodium Nitrite | about 5.0 |
| Polyvinyl Alcohol | about 2.0 |
| Mixture of $C_{12}$–$C_{14}$ Fatty Acids | about 13.0 |
| Starch | about 1.0 |

| | B % By Weight | C % By Weight |
|---|---|---|
| Potassium Soap of Coconut and Tall Oil | about 22.0 | about 20.0 |
| Mixture of Sodium & Potassium Borates | about 15.0 | about 12.0 |
| Oleic Acid | about 3.5 | about 4.0 |
| Polymer Mixture of Polyethylene and Polyethylene-vinyl acid co-polymer | about 2.0 | about 6.0 |
| Water balance | — | — |
| Starch | about 1.0 | about 0.5 |

| D | % By Weight |
|---|---|
| Potassium Pentaborate | about 40.0 |
| High Titre Soap (38° C.) | about 60.0 |

| E | % By Weight |
|---|---|
| Potassium Pentaborate | about 20.0 |
| High Titre Soap (38° C.) | about 30.0 |
| Mineral Acid | about 1.5 |
| Water | Gal. |

| F | % By Weight |
|---|---|
| Potassium Tetraborate | about 3.0 |
| Sodium Borate | about 3.0 |
| Phosphate Starch Ester | about 6.0 |
| High Titre Soap (45° C. Titre) | about 76.0 |
| Poly Vinyl Alcohol | about 3.0 |
| High Molecular Wt. Co-polymer of Poly Vinyl-Acetate | about 3.0 |
| Sodium Nitrite | about 6.0 |

The coatings were cast in accordance with the ASTM test D-1321 in deep round dishes approximately 3 inches in diameter. The hardness of each cast coating was measured according to ASTM test D-1321. The results of the hardness test are shown in Table 1.

TABLE 1

COMPARATIVE HARDNESS IN UNDER ASTM TEST D-1321 OF COATINGS ACCORDING TO THE INVENTION AND OTHER COMMERCIAL LUBRICANTS.

| | |
|---|---|
| A | 24 |
| B | 40 |
| C | 25 |
| D | 20 |
| E | 35 |
| F | 12 |
| Example 1 | 8 |

The hygroscopicity of the coatings according to the invention were tested and compared to the commercial lubricants A to F described above. Eight 3 inches×4 inches test panels which were cut from Q Panels of cold rolled steel with one side coated with zinc pigmented paint and one side coated with aluminum pigmented paint were coated by dipping with an aqueous composition of the composition of Example 1. The composition of Example 1 was dissolved at a concentration in water to provide a coating weight upon drying of about 400 mg/gt$^2$. The uncoated panels were first weighed and then were completely coated, oven dried in moving air at 120° F. for 24 hours and weighed again. The panels were then stored for 24 hours at 90% humidity and weighed again, their increase in weight due to the accumulation of moisture. The results of the test are described in Table 2.

TABLE 2

THE RELATIVE HYGROSCOPIC PROPERTIES OF COATINGS ACCORDING TO THE INVENTION AND COMMERCIAL LUBRICANT COATING MATERIALS.

| | Initial Panel Wt. (Grs.) | Panel Wt. After Coating (Grs.) | Coating Wt. (Grs.) | Coating Wt. Mg/Ft$^2$ | Wt. (Grs.) After 24 Hr. 90% H. | Increase in Wt. (Grs.) | % Moisture Accumulation |
|---|---|---|---|---|---|---|---|
| A | 52.6914 | 52.7588 | 0.0674 | 404 | 52.7680 | 0.0092 | 13.6 |
| B | 53.1033 | 53.1715 | 0.0694 | 409 | 53.1833 | 0.0118 | 17.0 |
| C | 52.3198 | 52.3919 | 0.0721 | 432 | 52.3979 | 0.0060 | 8.3 |
| D | 52.7561 | 52.8220 | 0.0659 | 395 | 52.8329 | 0.0109 | 16.5 |
| E | 53.1125 | 52.1831 | 0.0705 | 423 | 53.1955 | 0.0124 | 17.6 |
| F | 52.9376 | 53.0059 | 0.0683 | 410 | 53.0107 | 0.0048 | 7.0 |
| Example 1 | 53.2651 | 53.3369 | 0.0718 | 431 | 53.3420 | 0.0051 | 7.1 |
| Example 1 | 52.8349 | 52.9034 | 0.0685 | 411 | 52.9083 | 0.0049 | 7.2 |
| Uncoated Control | 52.7278 | — | — | — | 52.7326 | 0.0048 | — |

The lubricity of coatings according to the invention was tested and compared to the commercial lubricants described above, by testing the drawability of strips coated with the compositions to be tested. The drawability of coated strips was determined by use of a machine consisting essentially of two components: (1) a die block assembly which holds flat dies in position and provides the hydraulic loading on the dies and test strip while remaining stationary during the test; and (2) a gripping assembly which holds one end of the test strip and moves upward pulling the other end of the strip through the stationary dies. The force needed to move the gripping assembly while the coated test strip is between the dies provides a measure of the lubrication provided by the coating on the test strip. In accordance with the testing procedure test panels (Q-Panel Co.) of standard QD-412 cold rolled steel were dip coated in the test solution of a aqueous mixture of coating composition for two minutes and air dried for at least two hours at ambient temperature to provide a coating weight of about 400 mg/ft$^2$. The two flat dies were cleaned with isopropyl alcohol to remove any residual lubricant from the previous test, redressed with fine grade emergy paper and wiped with alcohol again. The coated test strip was then placed between the dies and load applied to the dies. The other end of the test strip was placed between the jaws of the gripping assembly and the machine started. The gripping assembly moved upward, and as it did, the jaws moved closer together until they gripped the test strip. This allowed a uniform and consistent rate of loading of the strip. At this point, the other end of the strip began to move between the dies. The pressure necessary to keep the gripping assembly moving at a constant rate was shown on a pressure gauge and automatically recorded by a pressure transducer. After the draw, the dies and test strip were examined for transfer of lubricant from the test strip to the dies and rated as none (5), slight (4), moderate (3), severe (2), or total (1). Excessive transfer of the lubricating drawing compound precludes the use of the material in normal production where the material could build up in dies and affect tolerances. The recorded drawing forces were examined and rated as 5 for very low force, i.e., excellent drawability and 1 for very high force, or very poor drawability. The final drawability rating was achieved by multiplying the material transfer index by 60 percent and the drawing force index by 40 percent. These two numbers were then added and rounded off to the closest integer to yield an overall drawability rating. If total transfer of material occurred or the dies were scored by the test strip, the drawability index was automatically set at 1 (poor).

The ratings were used to determine a coefficient of friction values by the following formula:

$$\text{Coefficient of friction Value} = \frac{1/\text{Rating}}{\left(\text{Cross sectional Area}\right)\left(\text{hold down pressure}\right)}.$$

The lower the coefficient the better the lubricity.

Tables 3, 4, 5 and 6 set forth results of tests on unpainted strips stored at 60% relative humidity at 70° F., a condition commonly found in industry (Table 3); and tests on unpainted panels aged for 5 days at 90% relative humidity and 100° F., a condition found during summer months (Table 4); tests on panels painted as described in the tests shown in Table 2 wherein the panels were stored at 60% relative humidity for 5 days at 70° F. (Table 5) and at 90% relative humidity at 100° F. (Table 6).

TABLE 3

COEFFICIENT OF FRICTION VALUES OF UNPAINTED 1" × 12" STRIPS CUT FROM Q PANELS WITH COATING WEIGHT OF ABOUT 400 MG/FT$^2$, HOLD DOWN OF 4,000 LBS./IN$^2$ AND COATED STRIP AGED IN 60% RELATIVE HUMIDITY AT 70° F. FOR 5 DAYS.

| Products | Value | Coating Wt. (Mg/Ft$^2$) |
|---|---|---|
| A | 0.105 | 408 |
| B | 0.100 | 406 |
| C | 0.098 | 399 |
| D | 0.119 | 398 |
| E | 0.127 | 417 |
| F | 0.099 | 411 |
| Example 1 | 0.084 | 416 |
| Example 1 | 0.081 | 397 |

TABLE 4

COEFFICIENT OF FRICTION VALUES OF UNPAINTED 1" × 12" STRIPS CUT FROM Q PANELS WITH A COATING WEIGHT OF ABOUT 400 MG/FT$^2$, AGED FOR 5 DAYS AT 90% RELATIVE HUMIDITY AT 100° F. AND HOLD DOWN OF ABOUT 4,000 LBS/IN$^2$.

| Product | Value | Initial Coating Wt. (Mg/Ft$^2$) |
|---|---|---|
| A | 0.117 | 408 |
| B | 0.131 | 406 |
| C | 0.112 | 399 |
| D | Chatter no value | 398 |
| E | Chatter no value | 417 |
| F | 0.109 | 411 |
| Example 1 | 0.098 | 416 |
| Example 1 | 0.097 | 397 |

TABLE 5

COEFFICIENT OF FRICTION VALUES OF 1" × 12" PAINTED STRIPS CUT FROM Q PANELS WITH COATING WEIGHT OF ABOUT 400 MG/FT$^2$, HOLD DOWN 4,000 LBS/IN$^2$ AND THE COATED STRIPS AGED IN 60% RELATIVE HUMIDITY AT 70° F. FOR 5 DAYS.

| Product | Value | Initial Coating Wt. (Mg/Ft$^2$) |
|---|---|---|
| A | 0.099 | 408 |
| B | 0.096 | 406 |
| C | 0.093 | 399 |
| D | 0.109 | 398 |
| E | 0.120 | 417 |
| F | 0.087 | 411 |
| Example 1 | 0.078 | 416 |
| Example 1 | 0.079 | 397 |

TABLE 6

COEFFICIENT OF FRICTION VALUES OF 1" × 12" PAINTED STRIPS CUT FROM Q PANELS WITH COATING WEIGHT OF ABOUT 400 MG/FT$^2$, HOLD DOWN 4,000/IN$^2$ AND THE COATED STRIPS AGED FOR 5 DAYS AT 90% HUMIDITY AT 100° F.

| Product | Value | Initial Coating Wt. (Mg/Ft$^2$) |
|---|---|---|
| A | 0.115 | 408 |
| B | 0.129 | 406 |
| C | 0.109 | 399 |
| D | 0.141 | 398 |
| E | Chatter no value | 417 |
| F | 0.101 | 411 |
| Example 1 | 0.089 | 416 |
| Example 1 | 0.090 | 397 |

The corrosion resistance supplied by the coatings of the invention were tested and compared to the above commercial lubricants by coating unpainted 3"×4" strips cut from Q Panels with the composition of the invention and other lubricants. The coated strips were then submitted to ASTM test DD2247, and the time taken to when the strips first begin to rust and the time take to when about 5% of the surface area of the strips are rusted. The results of the test are shown in Table 7.

TABLE 7

CORROSION RESISTANCE OF FERROUS METAL COATED FERROUS METAL STRIPS.

| | Coating Wt. (Mg/Ft$^2$) | Days 1st Rust | Days 'til 5% Rust |
|---|---|---|---|
| A | 406 | 8 | 10 |
| B | 410 | 5 | 6 |
| C | 431 | 7 | 8 |
| D | 396 | 5 | 7 |
| E | 421 | 4 | 5 |
| F | 409 | 9 | 11 |
| Example 1 | 429 | 12 | 17 |
| Example 1 | 409 | 11 | 16 |
| Uncoated Control | — | 1 | 1 |

Many compositions commercially available are known to provide coatings which not only lose weight but also have lost their lubricity over time at low humidities. The stability of the coatings provided by the invention were tested and compared to the above described commercial compositions. Strips 3"×4" cut from Q Panels of cold rolled steel were weighed and then coated to provide a weight gain of about 700 mg. The coated strip was weighed and stored at 10% relative humidity at 70° F. The strips were weighed after 24 hours and 120 hours. The results are shown in Table 8.

TABLE 8

STABILITY OF SOLID LUBRICATING AND COATING COMPOSITIONS AT 10% RELATIVE HUMIDITY AT 70° F.

| | Initial Panel Wt. (Grs.) | Panel Wt. After Coating (Grs.) | Coating Wt. (Grs.) | Coated Panel Wt. (Grs.) After 24 Hrs. | % Loss After 24 Hrs. | Coated Panel Wt. (Grs.) After 120 Hrs. | % Loss After 120 Hrs. |
|---|---|---|---|---|---|---|---|
| A | 49.2107 | 49.2808 | 0.0701 | 49.2791 | 2.4 | 49.2752 | 8.0 |
| B | 49.0018 | 49.3525 | 0.0699 | 49.3490 | 5.0 | 49.3448 | 11.0 |
| C | 48.9856 | 49.0571 | 0.0715 | 49.0550 | 2.9 | 49.0525 | 6.4 |
| D | 49.6572 | 49.7254 | 0.0682 | 49.7217 | 5.4 | 49.7189 | 9.5 |
| E | 48.9980 | 49.0683 | 0.0703 | 49.0639 | 6.3 | 49.0604 | 11.2 |
| F | 49.0716 | 49.1412 | 0.0696 | 49.1397 | 2.2 | 48.1373 | 5.6 |
| Example 1 | 48.3243 | 48.3957 | 0.0714 | 48.3943 | 2.0 | 48.3931 | 3.6 |
| Example 1 | 49.0532 | 49.1238 | 0.0706 | 49.1224 | 2.0 | 49.1213 | 3.5 |

It should be understood that while certain preferred embodiments of the present invention have been illustrated and described, various modifications thereof will become apparent to those skilled in the art. Accordingly, the scope of the present invention should be defined by the appended claims and equivalents thereof.

Various features of the invention are set forth in the following claims.

What is claimed is:

1. A solid lubricating and coating composition for a metal workpiece which composition is suitable for addition to water for the formation of an aqueous lubricating and coating composition which upon application to the workpiece and drying will provide a borate free hard lubricating coating, the solid composition comprising:

from about 55 to about 80 percent by weight of a solid alkali metal salt of a saturated fatty monocarboxylic acid having from about 12 to about 30 carbon atoms which may be in a chain or branched which salt has a melting point from about 105° to about 150° F.;

from about 4.5 to about 18 percent by weight of a solid polyethylene polymer selected from the group consisting of polyethylene glycol, methoxy polyethylene glycol, polyoxyethylene alcohol or mixtures thereof, the polyethylene polymer having a molecular weight in the range of from about 1500 to about 8000;

an effective amount of an acrylic polymer having a molecular weight in the range of from about 150 to about 1700 to accelerate drying and effect hardening of the aqueous composition upon the workpiece; from about 2.5 to about 7.5 percent by weight of a low hydrophilic-lipophilic balance surface active agent to effect hardness and low hygroscopicity to the coating; and an effective amount of a dispersing surface active agent to effect complete mixing of the alkali metal salt, polyethylene polymer, acrylic polymer and low hydrophilic-lipophilic balance surface active agent in water to provide an aqueous lubricating and coating composition which will form a borate free, hard lubricating coating.

2. A composition as recited in claim 1 wherein the acrylic polymer comprises from about 0.3 to about 1.2 percent by weight of the solid lubricating and coating composition.

3. A composition as recited in claim 2 wherein the polyethylene polymer is polyethylene glycol having a molecular weight in the range of from about 3000 to about 4800 and wherein after drying the borate free hard lubricating coating has a hardness in the range of from about 7 to about 15 as measured by ASTM test D-1321.

4. A composition as recited in claim 2 wherein the polyethylene polymer is polyoxyethylene alcohol.

5. A composition as recited in claim 2 wherein the alkali metal salt is a sodium or potassium salt.

6. A composition as recited in claim 2 wherein the dispersing surface active agent has a hydrophilic-lipophilic balance in the range of from about 10 to about 11 and comprises from about 2.5 to 8.0 percent by weight of the solid lubricating and coating composition.

7. A composition as recited in claim 3 wherein the alkali metal salt is a sodium or potassium salt and the salt has from 18 to 20 carbon atoms.

8. A composition as recited in claim 3 wherein the low hydrophilic-lipophilic balance surface active agent is diethylene glycol stearate.

9. A composition as recited in claim 6 wherein the alkali metal salt is a sodium or potassium salt and the salt has from 18 to 20 carbon atoms.

10. A composition as recited in claim 9 wherein the dispersing surface active agent is sodium-n-methyl-n-oleoyl taurate.

11. A composition as recited in claim 10 wherein the alkali metal salt is sodium stearate.

12. An aqueous lubricating and coating composition for a metal workpiece which upon application to the workpiece will provide a borate free, hard lubricating coating, the aqueous composition comprising:

from about 50 to about 94 percent by weight water; and from about 6 to about 50 percent by weight of solid lubricant dispersed in the water, the solid lubricant including from about 55 to about 80 percent by weight of a solid alkali metal salt of a saturated fatty monocarboxylic acid having from about 12 to about 30 carbon atoms which may be in a chain or branched which salt has a melting point from about 105° to about 150° F.;

from about 4.5 to about 18 percent by weight of a solid polyethylene polymer selected from the group consisting of polyethylene glycol, methoxy polyethylene glycol, polyoxyethylene alcohol or mixtures thereof, the polyethylene polymer having a molecular weight in the range of from about 1500 to about 8000;

an effective amount of an acrylic polymer having a molecular weight in the range of from about 150 to about 1700 to accelerate drying and effect hardening of the aqueous composition upon the workpiece; from about 2.5 to about 7.5 percent by weight of a low hydrophilic-lipophilic balance surface active agent to effect hardness and low hygroscopicity to the coating; and an effective amount of a dispersing surface active agent to effect complete mixing of the alkali metal salt, polyethylene polymer, acrylic polymer and low hydrophilic-lipophilic balance and surface active agent in water to provide an aqueous lubricating and coating composition which will form a borate free, hard lubricating coating.

13. A composition as recited in claim 12 wherein the acrylic polymer comprises from about 0.3 to about 1.2 percent by weight of the solid lubricant.

14. A composition as recited in claim 13 wherein the polyethylene polymer is polyethylene glycol having a molecular weight in the range of from about 3000 to about 4800 and the lubricating coating has a hardness in the range of from about 7 to about 15 as measured by ASTM test D-1321.

15. A composition as recited in claim 13 wherein the polyethylene polymer is polyoxyethylene alcohol.

16. A composition as recited in claim 13 wherein the alkali metal salt is a sodium or potassium salt.

17. A composition as recited in claim 13 wherein the dispersing surface active agent has a hydrophilic-lipophilic balance in the range of from about 10 to about 11 and comprises from about 2.5 to about 8.0 percent by weight of the solid lubricant.

18. A composition as recited in claim 14 wherein the alkali metal salt is a sodium or potassium salt and the salt has from 18 to 20 carbon atoms.

19. A composition as recited in claim 14 wherein the low hydrophilic-lipophilic balance surface active agent is diethylene glycol stearate.

20. A composition as recited in claim 17 wherein the alkali metal salt is a sodium or potassium salt and the salt has from 18 to 20 carbon atoms.

21. A composition as recited in claim 20 wherein the dispersing surface active agent is sodium-n-methyl-n-oleoyl taurate and the alkali metal salt is sodium stearate.

22. A method of lubricating and coating a workpiece comprising:

coating the workpiece with an aqueous solution which includes from about 50 to about 94 percent by weight water;

from about 6 to about 50 percent by weight of solid lubricant dispersed in the water, the solid lubricant including from about 55 to about 80 percent by weight of a solid alkali metal salt of a saturated fatty monocarboxylic acid having from about 12 to about 30 carbon atoms which may be in a chain or branched which salt has a melting point from about 105° to about 150° F.;

from about 4.5 to about 18 percent by weight of a solid polyethylene polymer selected from the group consisting of polyethylene glycol, methoxy polyethylene glycol, polyoxyethylene alcohol or mixtures thereof, the polyethylene polymer having a molecular weight in the range of from about 1500 to about 8000;

an effective amount of an acrylic polymer having a molecular weight in the range of from about 150 to about 1700 to accelerate drying and effect hardening of the aqueous composition upon the workpiece; from about 2.5 to about 7.5 percent by weight of a low hydrophilic-lipophilic balance surface active agent to effect hardness and low hygroscopicity to the coating; and an effective amount of a dispersing surface active agent to effect complete mixing of the alkali metal salt, polyethylene polymer, acrylic polymer and low hydrophilic-lipophilic balance and surface active agent in water;

and drying the coating to provide a coated lubricated workpiece.

23. A composition as recited in claim 2 wherein the polyethylene polymer is methoxy polyethylene glycol.

24. A composition as recited in claim 13 wherein the polyethylene polymer is methoxy polyethylene glycol.

25. A method as recited in claim 22 wherein the polyethylene polymer is polyethylene glycol having a molecular weight in the range of from about 3000 to about 4800 and the lubricating coating has a hardness in the range of from about 7 to about 15 as measured by A.S.T.M. Test D-1321.

26. A method as recited in claim 22 wherein the polyethylene polymer is polyoxyethylene alcohol.

27. A method as recited in claim 22 wherein the polyethylene polymer is methoxy polyethylene glycol.

28. A method as recited in claim 22 wherein the dispersing surface active agent has a hydrophilic-lipophilic balance in the range of from about 10 to about 11 and comprises from about 2.5 to 8.0 percent by weight of the solid lubricant.

29. A method as recited in claim 28 wherein the alkali metal salt is a sodium or potassium salt and the salt has from 18 to 20 carbon atoms and the acrylic polymer comprises from about 0.3 to about 1.2 percent by weight of the solid lubricant.

* * * * *